US005140830A

United States Patent [19]

Sawyer

[11] Patent Number: 5,140,830

[45] Date of Patent: Aug. 25, 1992

[54] SELF-CONTAINED INDOOR AIR CONDITIONING SYSTEM

[75] Inventor: Kevin W. Sawyer, Olive Hill, Ky.

[73] Assignee: Consolidated Technology Corporation, Olive Hill, Ky.

[21] Appl. No.: 784,918

[22] Filed: Oct. 30, 1991

Related U.S. Application Data

[63] Continuation-in-part of Ser. No. 607,250, Oct. 31, 1990, abandoned.

[51] Int. Cl.[5] ..... F25D 19/00

[52] U.S. Cl. ..... 62/298; 62/302; 62/324.1

[58] Field of Search ..... 62/263, 298, 324.1, 62/302

[56] References Cited

U.S. PATENT DOCUMENTS

| | | | |
|---|---|---|---|
| 3,712,078 | 1/1973 | Maynard et al. | 62/298 X |
| 3,766,749 | 10/1973 | Livesay | 62/298 X |
| 4,457,140 | 7/1984 | Rastelli | 62/298 X |
| 4,977,750 | 12/1990 | Metcalfe | 62/298 X |

*Primary Examiner*—William E. Tapolcai

[57] ABSTRACT

A self-contained indoor air conditioning system includes a removable chassis comprising an indoor air condensor/evaporator, an outdoor air condensor-/evaporator and a compressor. The chassis can be easily removed from the housing enclosure and taken to a nearby repair station for a major overhaul. Flanges and bulkheads are provided on the chassis and interiorly of the housing to separate air flow to the indoor and outdoor blower fans which are positioned in the upper portion of the housing proximate the electric controls.

20 Claims, 4 Drawing Sheets

SELF-CONTAINED INDOOR AIR CONDITIONING SYSTEM

This is a continuation in part of pending patent application Ser. No. 07/607,250 filed Oct. 31, 1990 now abandoned.

BACKGROUND OF THE INVENTION

1. Field Of The Invention

The invention is concerned with an air to air cooling and heating system for the interior of a building, particularly an inside self-contained system utilizing indoor and outdoor air condensor/evaporators within a single housing.

2. Description Of The Prior Art And Objectives Of The Invention

Self-contained, interior heating and cooling systems have been utilized in the past as set forth in U.S. Pat. Nos. 4,644,759 and 4,598,558. Such devices are commonly referred to as interior heat pumps and have been used for many years with varying degrees of success. In recent years, costs of labor and maintenance have escalated and such self-contained units must be readily serviceable at usual rates to remain competitive in the marketplace. Repairmen have been aware for many years that service can be accomplished quicker in most instances, inside an equipped shop as opposed to attempting major repairs within the owner's home or building. In self-contained air conditioning (heating and cooling) systems, problems often exist with either the indoor air condensor/evaporator coil, the outside air condensor/evaporator coil or the compressor. These elements require most of the expensive, time consuming maintenance although electrical circuit failures, while equally as important, can usually be corrected at the job site with relatively small, simple test and repair equipment.

Thus, with an understanding of the disadvantages and problems associated with repairing self-contained heat pump systems, the present invention was conceived and one of its objectives is to provide a self-contained heating and cooling system for the interior air of a building which includes an easily removable chassis which includes the indoor air condensor/evaporator, the outdoor air condensor/evaporator and the compressor.

It is another objective of the present invention to provide a self-contained heating and cooling system in which a single repairman can remove the chassis and service or exchange for a replacement chassis in a matter of minutes.

It is yet another objective of the present invention to provide a self-contained heating and cooling system which includes a removable chassis having quick disconnect electrical connectors.

It is still yet another objective of the present invention to provide a removable chassis having opposingly mounted indoor and outdoor air condensor/evaporators.

It is also an objective of the present invention is to provide a self-contained heating and cooling system which provides within a single housing, a pair of blower fans which are positioned vertically above, respectively of the indoor and outdoor condensor/evaporators.

It is yet still another objective of the present invention to provide a self-contained heating and cooling system in which the removable chassis includes a sealing flange and bulkhead for cooperatively engaging a housing flange and bulkhead which, by respectively mating, prevents an air flow between the outdoor air condensor/evaporator and the indoor air condensor/evaporator.

It is a further objective of the invention to provide a self-contained heating and cooling system which can be modified for various temperature conditions or desires of the purchaser.

Various other objectives and advantages of the present invention become apparent to those skilled in the art as a more detailed presentation of the invention is presented below.

SUMMARY OF THE INVENTION

The objectives mentioned above and others are realized by providing a self-contained cooling and heating system for a building or the like having a housing enclosing a refrigerant compressor, an indoor air condensor/evaporator, an outdoor air condensor/evaporator, and indoor and outdoor blower fans for providing a closed refrigerant circuit system. A removable chassis is contained within the housing which includes a planar base member upon which the compressor, the indoor air condensor/evaporator and the outdoor air condensor/evaporator are mounted. Electrical controls are positioned within the upper portion of the housing along with the indoor blower and outdoor blower fans. The chassis is electrically connected to the controls by quick disconnect fittings whereby the chassis can be removed from the housing and taken into a shop for a major overhaul, or can be easily accessible for the repairman.

DESCRIPTION OF THE PREFERRED EMBODIMENT

Figure 2:
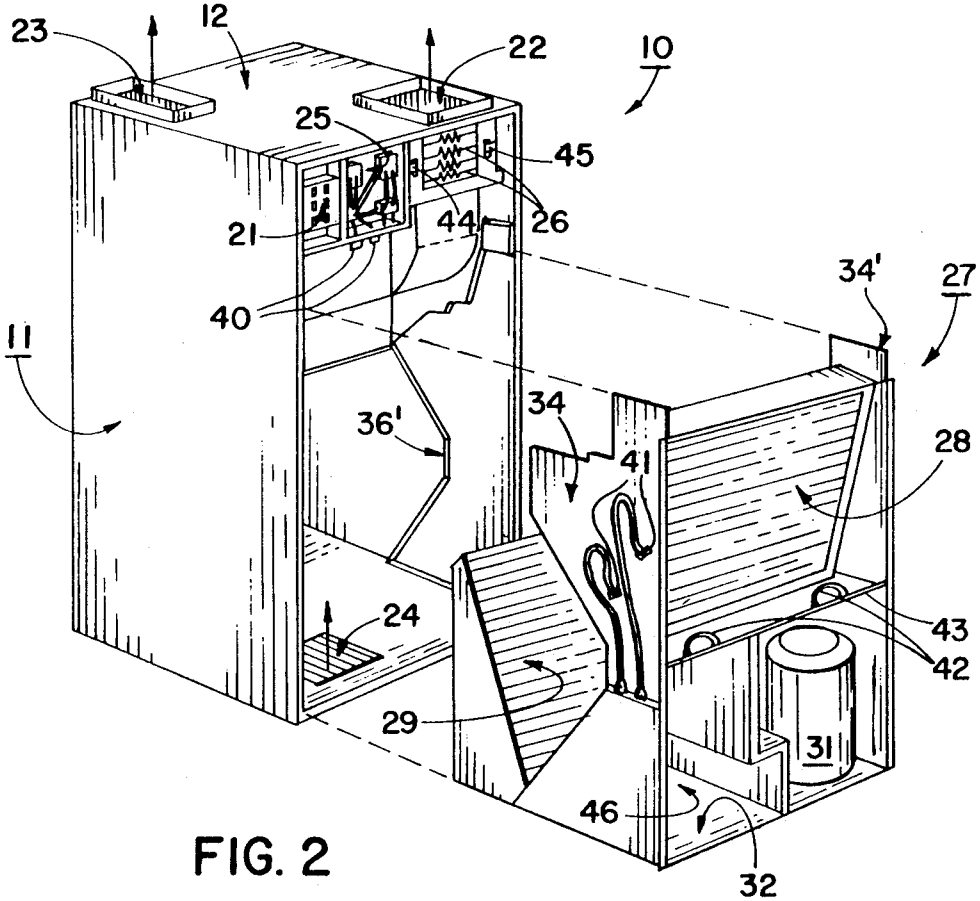
FIG. 2 illustrates the system as shown in FIG. 1 with the front panel removed and with the refrigerant chassis removed therefrom.
Figure 1:
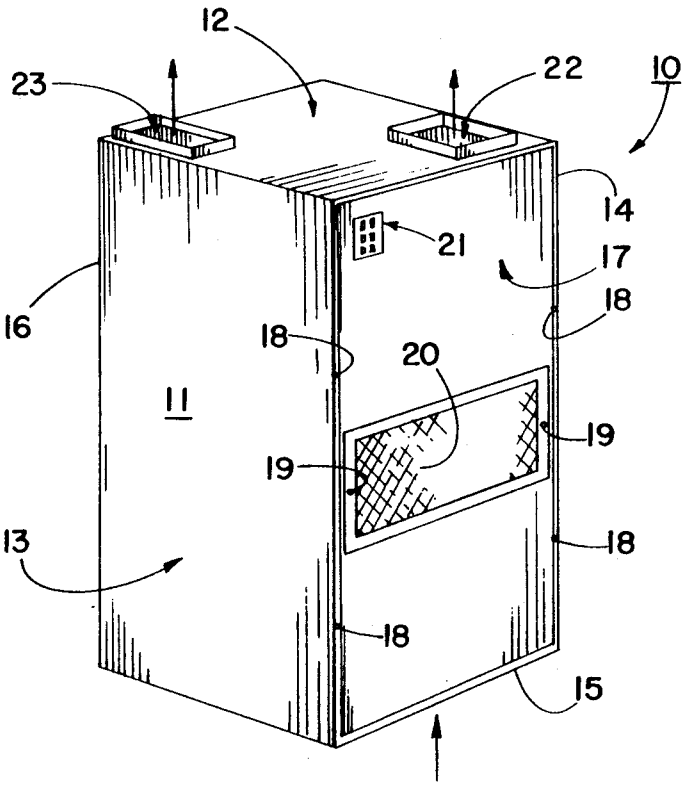
FIG. 1 demonstrates in perspective fashion the front, top and left side of a self-contained indoor air conditioning system without the usual duct work connected thereto.

The preferred apparatus of the invention is shown in FIGS. 1 and 2 whereby a self-contained heating and air conditioning system, commonly referred to as heat pump is contained within a single metal housing and includes a refrigerant circuit comprising a compressor, an indoor air condensor/evaporator having a refrigerant coil, and an outdoor air condensor/evaporator also having a refrigerant coil, an indoor blower fan and an outdoor blower fan for providing conditioned air to an enclosed structure. As shown in FIG. 2, a removable chassis includes a substantially flat, planar base upon which the compressor, indoor air condensor/evaporator and outdoor air condensor/evaporator are mounted. The removable chassis is slidably receivable within the housing and is electrically joined by quick disconnect fittings to the control circuits mounted within the housing. Side chassis sealing flanges engage housing sealing flanges and a chassis bulkhead engages a housing bulkhead upon assembly to define separate air flow paths for the indoor and outdoor condensor/evaporators thus providing two different conditioned air routes within the housing.

DETAILED DESCRIPTION OF THE DRAWINGS AND OPERATION OF THE INVENTION

For a better understanding of the invention and its operation, turning now to the drawings, FIG. 1 shows a self-contained indoor air conditioning system 10 comprising housing 11 formed from galvanized sheet metal or the like. Housing 11 forms a container having a top 12, left side 13, right side 14, bottom 15, a rear 16 (not shown in FIG. 1), and front 17. Housing 11 can also be made in a variety of conventional ways but as shown in FIG. 1, front 17 is attached by sheet metal screws 18 along the edges thereof to hold it in place. Inlet air grill 20 conceals an air filter positioned therebehind which is accessible by removing grill 20 by rotating thumb screws 19 thereon. Circuit breakers 21 which are factory installed are also accessible from the front of housing 11 without the necessity of removing front 17. As would be understood, system 10 is shown without exterior duct work such as would be attached to indoor air discharge opening 22 and outdoor air discharge opening 23. The explanation of the heating/cooling cycle of system 10 is not explained in detail herein as it is conventional in self-contained heat pump systems.

In FIG. 2 bottom outdoor air intake opening 24 is shown with housing 11 having front 17 removed therefrom. Air entering opening 24 may come from the crawl space beneath a house thereby presenting Radon gas accumulation and danger to the homeowner as the air withdrawn is subsequently exhausted through opening 23 and does not mix with the indoor conditioned air. Front 17 may have one or more panels but in FIG. 1, only one large front panel is provided. Also, in FIG. 2, electrical controls 25 are shown in schematic fashion, and are conventional heat pump controls. Heating strips 26, which are conventional electrical resistant heating strips, are available for low outdoor temperature operation as would be understood. Also, with refrigerant chassis 27 removed, system 10 can be initially purchased very inexpensively and be used as an electric furnace in winter-like weather. Later, chassis 27 can be installed for heating and cooling purposes. In place of heating strips 26, hot water coils or steam coils heated by an adjacent gas or electric hot water heater could be used. Such coils would be connected to copper inlet pipe 44 and copper outlet pipe 45 shown in stub fashion in FIG. 2.

Figure 4:
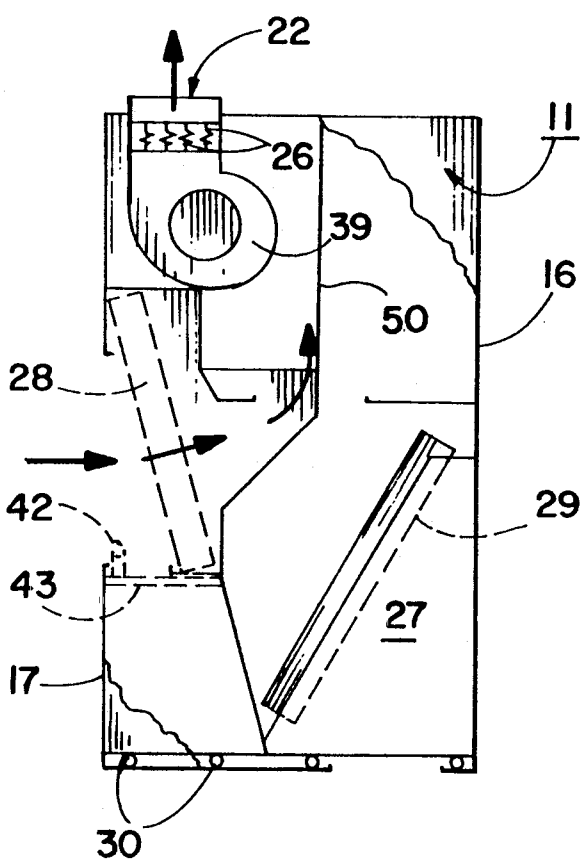
FIG. 4 demonstrates a right side view of the system as shown in FIG. 1 in schematic fashion demonstrating the indoor air flow.
Figure 3:
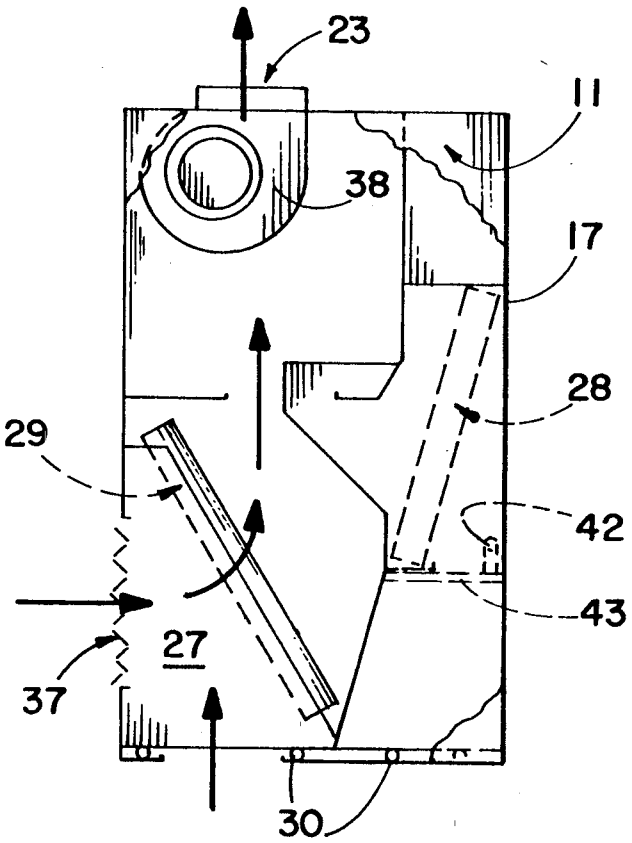
FIG. 3 shows a left side view of the system of FIG. 1 in schematic fashion demonstrating the outdoor air flow.

Refrigerant chassis 27 can be slidably mounted in housing 11 or may, for example, include a series of rollers 30 as shown in the embodiment pictured in FIGS. 3 and 4. Rollers 30 are rotatably attached to chassis 27 and may be used for larger air conditioning systems which are heavier and thus more difficult to slide from housing 11. Chasis 27 as shown in FIG. 2 includes an indoor air condensor/evaporator 28, outdoor air condensor/evaporator 29 and a refrigerant compressor 31 mounted below condensor/evaporator 28. Conventional refrigerant gases such as sold under the trademark Freon can be used therein as is standard in the refrigerant and heat pump industries. The system as normally installed would include a reversing valve as with conventional self-contained heat pumps, however if desired system 10 can be supplied without the reversing valve and be used simply as an air conditioning unit. This illustrates one of the versatile features of system 10. Electrical housing couplings 40 mate with chassis couplings 41 as shown in FIG. 2 for providing a quick electrical disconnect of refrigerant chassis 27 from housing 11. Thus, if a major problem develops in air conditioning system 10 a repairman can simply remove front panel 17, grasp handles 42 which are mounted on transverse chassis member 43, easily removing it from housing 11 where it can be placed in a small service van and taken to an equipped shop for repair purposes. As would be further understood, under certain service conditions a replacement chassis may be provided to the system owner so very little down time is experienced.

Figure 6:
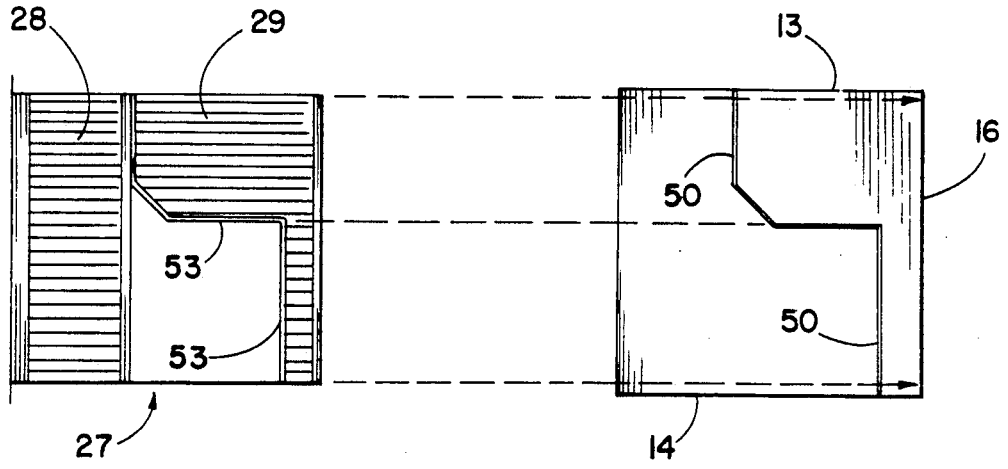
FIG. 6 depicts the chassis removed from the housing as in FIG. 5 to illustrate the chassis and housing sealing flanges from a top plan view.
Figure 5:
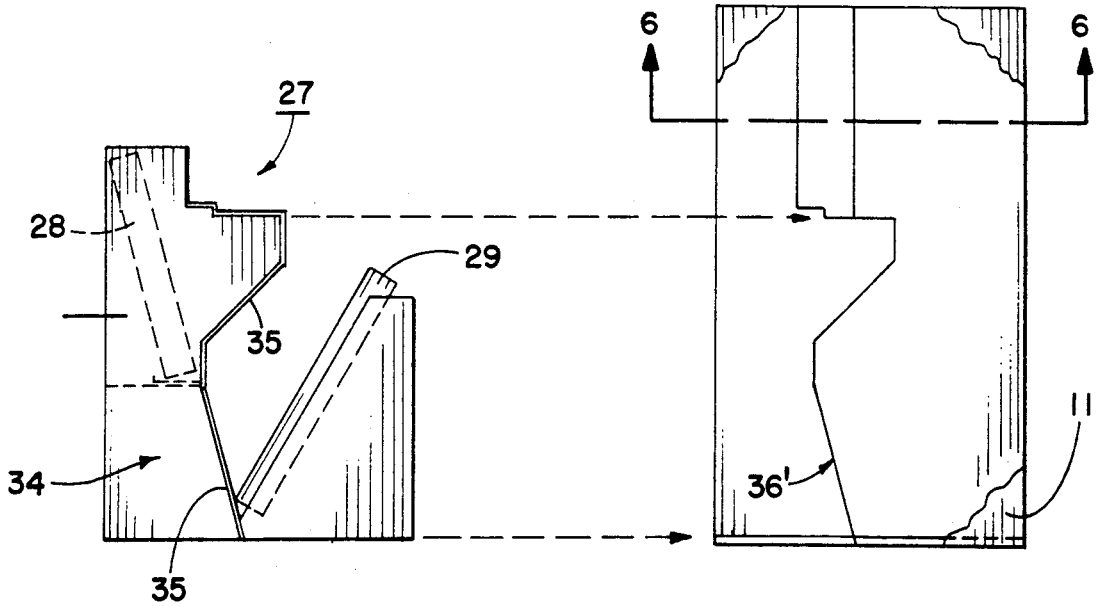
FIG. 5 pictures a right side view of the self-contained system as shown in FIG. 1 with the chassis removed and demonstrating the side sealing flanges.
Figures 7, 8, 9:
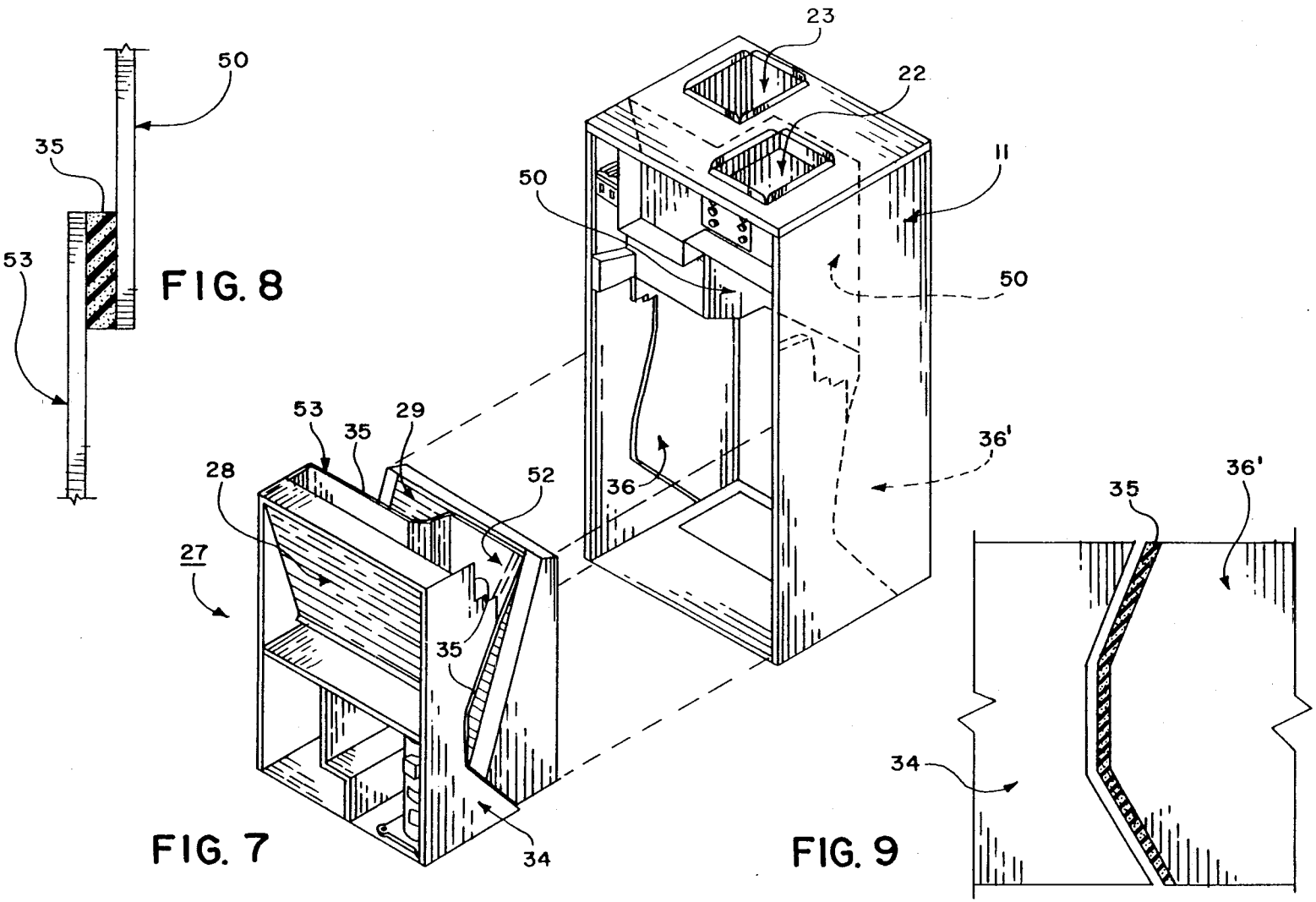
FIG. 7 provides a top right side perspective view of the air conditioning system with the chassis removed from the housing.
FIG. 8 shows an enlarged view of the mating engagement of the chassis bulkhead with the housing bulkhead.
FIG. 9 demonstrates the mating of the chassis and housing flanges.

As also seen in FIG. 2, compressor 31, indoor condensor/evaporator 28 and outdoor condensor/evaporator 29 are mounted on chassis base 32 which consists of a substantially planar reinforced sheet metal member which slides into and covers inside bottom 33 of housing 11. In order to maintain separation of the air which flows through indoor air condensor/evaporator 28 and outdoor air condensor/evaporator 29, in FIG. 7, chassis flanges 34, 34' and the top edge of chassis bulkhead 53 include a resilient seal 35 attached thereto. In FIGS. 8 and 9 the mating is shown in enlarged fashion. Seal 35 stops air migration between the indoor and outdoor condensor/evaporators 28 and 29 when chassis flanges 34, 34' engage housing flanges 36, 36' and chassis bulkhead 53 engages housing bulkhead 50 which are positioned internally of housing 11 to accommodate fluid communication between outdoor air condensor/evaporator 29 and blower fan 38, and indoor air condensor/evaporator 28 and indoor blower fan 39. In FIG. 4 blower fan 39 is shown above condensor/evaporator 28. As seen in FIGS. 2, 5 and 6, housing flange 36 is formed from sheet metal as is chassis flange 34 and bulkheads 50, 53. Housing flange 36 and substantially vertical bulkhead 50 are secured internally of housing 11 such as may be accomplished by sheet metal screws, welding or otherwise.

Condensor/evaporators 28 and 29 are opposingly mounted on chassis 27 in biased fashion with the bottom of each slanted inwardly (FIG. 3). Rear 16 of housing 11 may include an optional air intake grill 37, along with blower fan 38 positioned above condensor/evaporator 29. In FIG. 4 blower fan 39 is shown above condensor/evaporator 28. The opposingly mounted condensor/evaporators 28, 29 on chassis 27 provide energy savings and efficiency due to the close, compact arrangement therebetween and with compressor 31 as the Freon lines are very short compared to other systems.

As comprehended by those knowledgeable in the trade, system 10 of the invention includes centrifugal blowers 38, 39 which are mounted above removable chassis 27 within the upper portion of housing 11 along with the major electrical circuitry and auxiliary resistant heating strips 26. These components are generally not subject to major problems or failure and can usually be repaired at the installation site. Refrigerant chassis 27, which includes components 28, 29 and 31 which are most commonly repaired, and can be easily removed by sliding chassis 27 from the lower portion of housing 11 and taken to tee shop or other convenient location for testing and repair. Hence, a very serviceable and functionable system is available for homeowners and others.

A compartment 46 is shown in chassis 27 (FIG. 2) which will accommodate a "desuperheater" as known in the trade. The desuperheater would consist of a jacket through which water would pass, said water receiving heat from an inner coil containing hot Freon from the condensor/evaporators. The desuperheater would thus function to cool the hot Freon, while at the same time be a source of hot water for any of a variety of internal or external purposes, such as hot water for dishwashing purposes, thus making available economical hot water heating when compared to the cost of standard electric or gas hot water heating.

The illustrations and examples provided herein are for explanatory purposes and are not intended to limit the scope of the appended claims.

I claim:

1. A self-contained indoor air conditioning system of the type having a compressor, an indoor air condensor-/evaporator, an outdoor air condensor/evaporator, an indoor blower fan, and an outdoor blower fan, all assembled within a housing to form a closed refrigerant circuit for providing conditioned air to an enclosed structure, said system further comprising:

a housing flange, a housing bulkhead, said flange and said bulkhead positioned in contiguous relation interiorly of said housing, a removable chassis, said chassis comprising a base, said compressor, indoor air condensor/evaporator and said outdoor air condensor/evaporator mounted on said base, a chassis flange, a chassis bulkhead, said chassis flange and bulkhead positioned on said base, said chassis flange for releasable engagement with said housing flange, and said chassis bulkhead for releasable engagement with said housing bulkhead whereby said flanges and bulkheads upon engagement define a pair of air flow paths within said housing.

2. The self-contained indoor air conditioning system of claim 1 and including an electrical connector, said connector for releasable attachment to said chassis.

3. The self-contained indoor air conditioning system of claim 1 wherein said indoor air condensor/evaporator is opposingly mounted on said chassis to said outdoor air condensor/evaporator.

4. The self-contained indoor air conditioning system of claim 1 wherein said compressor is positioned beneath said indoor air condensor/evaporator.

5. The self-contained indoor air conditioning system of claim 1 and including a transverse frame member, said frame member attached to said chassis.

6. The self-contained indoor air conditioning system of claim 5 and including a handle, said handle attached to said transverse frame member.

7. The self-contained indoor air conditioning system of claim 1 wherein said indoor air condensor/evaporator is slanted from top to bottom inwardly.

8. The self-contained indoor air conditioning system of claim 1 wherein said outdoor air condensor/evaporator is slanted from top to bottom inwardly.

9. The self-contained indoor air conditioning system of claim 1 wherein said outdoor blower fan is positioned in said housing above said removable chassis.

10. The self-contained indoor air conditioning system of claim 1 wherein said indoor blower fan is positioned in said housing above said removable chassis.

11. The self-contained indoor air conditioning system of claim 1 wherein said housing flange engages said chassis flange to provide an air flow path for the indoor condensor/evaporator separate from the air flow path of the outdoor condensor/evaporator.

12. The self-contained indoor air conditioning system of claim 11 wherein said housing flanges are positioned below said indoor and outdoor blowers.

13. The self-contained indoor air conditioning system of claim 10 wherein said removable chassis comprises a resilient seal, said seal for preventing air flow between said indoor air condensor/evaporator and said outdoor air condensor/evaporator as said chassis flanges engage said housing flanges.

14. The self-contained indoor air conditioning system of claim 13 wherein said resilient seal is attached to said chassis flanges.

15. The self-contained indoor air conditioning system of claim 1 wherein said outdoor blower fan is in fluid communication with said outdoor air condensor-/evaporator when said chassis is inserted into said housing.

16. The self-contained indoor air conditioning system of claim 1 wherein said indoor blower fan is in fluid communication with said indoor air condensor-/evaporator when said removable chassis is inserted into said housing.

17. The self-contained indoor air conditioning system of claim 1 wherein said removable chassis is slidably mounted within said housing.

18. The self-contained indoor air conditioning system of claim 1 wherein said removable chassis is roller mounted within said housing.

19. A self-contained indoor air conditioning system of the type having a compressor, an indoor air condensor-/evaporator, an outdoor air condensor/evaporator, an indoor blower fan, and an outdoor blower fan, all assembled within a housing to form a closed refrigerant circuit for providing conditioned air to an enclosed structure, said system further comprising:

a housing flange, a housing bulkhead, said flange and said bulkhead positioned interiorly of said housing, a removable chassis, said chassis comprising a base, said compressor, indoor air condensor/evaporator and said outdoor air condensor/evaporator mounted on said base, a chassis flange, a housing bulkhead, said chassis flange and said housing bulkhead positioned on said base, said chassis flange for releasable engagement with said housing flange and said chassis bulkhead for releasable engagement with said housing bulkhead whereby said flanges and bulkheads upon engagement define a pair of air flow paths within said housing, said engagement of said housing and said chassis flanges and bulkheads defining separate air flow paths for said outdoor and indoor condensor/evaporators.

20. The indoor air conditioning system of claim 19 and including a resilient seal, said seal attached to said chassis flanges and to said chassis bulkhead.

* * * * *